US006619901B1

(12) United States Patent
Duethorn et al.

(10) Patent No.: US 6,619,901 B1
(45) Date of Patent: Sep. 16, 2003

(54) METHOD AND APPARATUS FOR AIR GUIDANCE IN A PROCESSING CHAMBER

(75) Inventors: Berthold Duethorn, Aurachtal (DE); Thomas Hertfelder, Frankenhardt (DE); Eberhard Jost, Hattersheim (DE); Lothar Gail, Wiesbaden (DE)

(73) Assignee: Robert Bosch GmbH, Stuttgart (DE)

( * ) Notice: Subject to any disclaimer, the term of this patent is extended or adjusted under 35 U.S.C. 154(b) by 192 days.

(21) Appl. No.: 09/857,366

(22) PCT Filed: Sep. 27, 2000

(86) PCT No.: PCT/DE00/03396

§ 371 (c)(1),
(2), (4) Date: Jan. 23, 2002

(87) PCT Pub. No.: WO01/25694

PCT Pub. Date: Apr. 12, 2001

(30) Foreign Application Priority Data

Oct. 2, 1999 (DE) ..... 199 47 781

(51) Int. Cl.[7] ..... B65G 1/00
(52) U.S. Cl. ..... 414/217; 414/221
(58) Field of Search ..... 55/385.2; 454/49, 454/187; 414/217, 221

(56) References Cited

U.S. PATENT DOCUMENTS 5,316,518 A 5/1994 Challenger
5,536,320 A * 7/1996 Ushikawa et al. ..... 414/217 X
5,912,184 A * 6/1999 Young ..... 438/692
6,478,461 B1 * 11/2002 Frank ..... 366/25
6,535,270 B1 * 3/2003 Murayama ..... 355/30

FOREIGN PATENT DOCUMENTS

| | | | |
|---|---|---|---|
| DE | 38 36 696 C1 | | 12/1989 |
| DE | 43 32 657 C2 | | 3/1995 |
| EP | 0 195 703 | | 11/1988 |
| EP | 0 554 117 A2 | | 8/1993 |
| EP | 0 604 925 B1 | | 7/1994 |
| JP | 2001-328780 | * | 11/2001 |
| WO | WO 92/21920 | | 12/1992 |

OTHER PUBLICATIONS

Reinraumzonen In Der Pharmaindustrie, (Dipl. Ing. Reinhold Lehna, Boehringer Ingelheim KG, Ingelheim) 690 TAB 87 8.1 p. 33 and 34.

* cited by examiner

*Primary Examiner*—Harold Joyce
(74) *Attorney, Agent, or Firm*—Ronald E. Greigg

(57) ABSTRACT

An apparatus for air guidance in a processing chamber has a housing with an entrance gate and an exit gate. Inside the housing the processing chamber is embodied for filling and sealing small bottles or ampules. The processing chamber is separated from an outside region via an intermediate region. The intermediate region having a movable door by means of which manual interventions in the processing chamber can be made. The apparatus also has a ventilation system with a blower and a clean-air filter which inside the processing chamber generates a laminar air flow. By means of special air pressure ratios in the processing chamber the intermediate region the entrance gate and the exit gate, the occurrence of contamination, or its exceeding a tolerable amount, in the processing chamber (12) and the outside region is avoided.

20 Claims, 2 Drawing Sheets

METHOD AND APPARATUS FOR AIR GUIDANCE IN A PROCESSING CHAMBER

CROSS-REFERENCE TO RELATED APPLICATIONS

This application is a 35 USC 371 application of PCT/DE 00/03396 filed on Sep. 27, 2000.

BACKGROUND OF THE INVENTION

1. Field of the Invention

The invention relates to a method and an apparatus for air guidance in a processing chamber and in particular, to a method of and an apparatus for dispensing pharmaceuticals or similar products into packaging containers inside a housing of a packaging machine is intended.

2. Description of the Prior Art

Known apparatuses of the type with which this invention is concerned are often constructed by so-called isolator technology; that is, the filling and sealing of the packaging containers are done under clean-room conditions, so that neither the previously sterilized packaging containers nor the product can become contaminated from external factors. To that end, the filling and sealing region of the apparatus in particular is surrounded by a housing, in which the air located in the interior is either recirculated through a clean-air filter, or else constantly cleaned air is delivered from outside through a clean-air filter (European Patent Disclosure EP 0 604 925 B1). Also in such apparatuses, it is often necessary to be able to make manual interventions from outside in the production chamber, for example to adjust equipment. Intervention using gloves (EP 0 604 925 B1) and free intervention without gloves are both known methods. In the latter option, there is always the risk either of contamination of the production room from outside or contamination of the outside region from the production room itself.

SUMMARY OF THE INVENTION

The object of the invention is therefore to embody a method of and an apparatus for air guidance in a processing chamber in such a way that contamination of both the processing chamber or production room and of the outside region, from which manipulations in the production room are made, is precluded or at least reduced to a certain tolerable amount. This object is attained with a method and an apparatus according to the invention which are distinguished in that at the instant when interventions into the production room are made, in particular through a gap between the production room and the outside region, air flowing out of the production room in the direction of the outside region and vice versa is aspirated away via an interstice and thus cannot reach the respectively other region.

Further advantageous refinements of the method according to the invention and of its apparatus will become apparent from the description contained below, taken with the drawings, in which:

DESCRIPTION OF THE PREFERRED EMBODIMENTS

Figure 1:
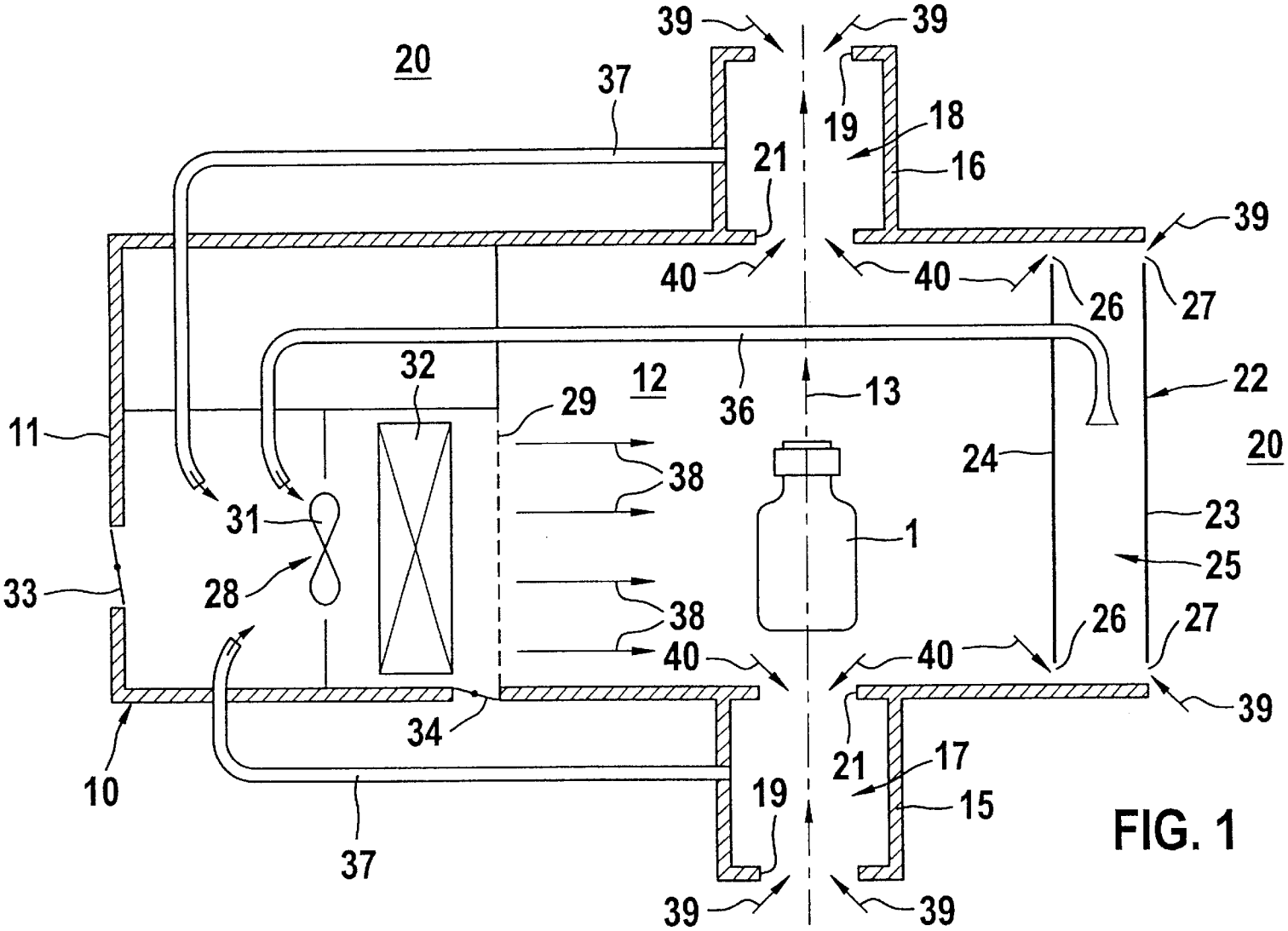
FIG. 1 is a schematic plan view of an apparatus for dispensing pharmaceuticals or similar products into packaging containers.

The apparatus 10 for dispensing dry pharmaceuticals, in particular, or similar products into packaging containers, such as small bottles 1, and sealing them has a housing 11. The housing 11 encloses a production chamber 12, in which processing devices, not shown because they are not essential to the invention, and in particular filling and sealing devices, are disposed. The bottles 1 are shunted by means of a conveyor system along a transport path 13 through the production chamber 12, and the housing 11 has one entrance gate 15 and one exit gate 16. The entrance gate 15 and the exit gate 16 each form one gate region 17, 18, which have first openings 19 from the outside region 20 of the apparatus 10 into the gate region 17, 18 and second openings 21 from the gate region 17, 18 into the production region 12. The size of the openings 19, 21 is preferably adapted to the size of the bottles 1 or is variable, so that the size of the openings 19, 21 is as small as possible, to avoid an excessive exchange of air among the various regions.

To make it possible to make manual interventions in the production chamber 12, an access capability is embodied on side of the housing 11, in the form of a double-disk door 22. The door 22 has a first disk 24 toward the production chamber 12 and a second disk 23 toward the outside region 20. The spacing of the two disks 23, 24 amounts to approximately 40 mm, for example. In order to indicate that the door 22 does not close the housing 11 in airtight fashion, gaps 26, 27 are drawn in in the region of the two disks 23, 24, toward the housing wall; by way of these gaps, a purposeful exchange of air takes place between the production chamber 12 and the interstice 25, between the two disks 23, 24, and between the outside region 20 and the interstice 25.

The access capability in the production chamber 12 exists in particular because the door 22 is embodied so as to be displaceable, or raisable and lowerable, thus creating a slit or free space through which one can reach manually into the production chamber,12. If the door 22 is open, then air can reach the interstice 25 via the slit or free space thus formed. It is also conceivable, at least in the one disk 24, also to provide a hole, through which a glove fastened to the other disk 23 (on the side toward the production chamber 12) can be guided.

On the side of the transport path 13 opposite the door 22, a ventilation system 28 is disposed in the housing 11; in the exemplary embodiment, it is separated from the production chamber 12 by an air-permeable device 29. The ventilation system 28 has a blower 31 and a filter following it, in the form of a clean-air filter 32. In the region of the ventilation system 28, on the suction side of the blower 31, the housing 11 has a first adjustable flap 33, to allow the controlled delivery of air from the outside region 20. On the pressure side of the blower 31, a second adjustable flap 34 is also provided, to enable the outflow of cleaned air into the outside region 20.

The apparatus 10 is embodied especially to prevent both contamination of the production chamber 12 from the outside region 20 and contamination in the opposite direction. To that end, the interstice 25 between the two disks 23, 24 communicates with the suction side of the blower 31 via a suction device or suction line, creating a flow path 36 for air. Further flow paths 37 for air are formed by the entrance gate 15 and the exit gate 16 toward the suction side of the blower 31. From the blower 31, the air cleaned in the clean-air filter 32 is carried into the production chamber 12, and a substantially horizontally extending, laminar air flow 38 is created, which flows via the processing spaces or processing faces of the bottles 1 in the direction of the interstice 25.

What is essential here is the different air pressure ratios in the various rooms or regions: In the production chamber 12, a higher pressure thus prevails than in the intermediate region 25 or in the entrance gate 15 and the exit gate 16. In addition, the pressure in the intermediate region 25, the entrance gate 15 and the exit gate 16 is less than in the outside region 20; that is, in these regions, in comparison with the outside region 20, a negative pressure prevails. As a consequence, not only does air from the outside region 20 flow via the first openings 19 into the entrance gate 15 and the exit gate 16, but also air via the gaps 27 or upon opening of the door 22 flows via the thusformed gap or free space into the intermediate region 25, as is meant to be indicated by the flow arrows 39. Air also flows out of the production chamber 12 via the second openings 21 into the entrance gate 15 and the exit gate 16, and air flows via the gaps 26 into the intermediate region 25, as is indicated by the flow arrows 40. Thus no air flow of uncleaned or contaminated air takes place out of the region outside the production chamber 12 into the production chamber 12. Nor does any uncleaned or contaminated air flow out of the production chamber 12 into the outside region 20. Contamination of the intermediate region 25 and of the gate regions 17, 18 from air emerging from the production chamber 12 or air entering the intermediate region 25 via the outside region 20 is avoided by the removal of the air by suction from the aforementioned regions to the suction side of the blower 31.

Figure 3:
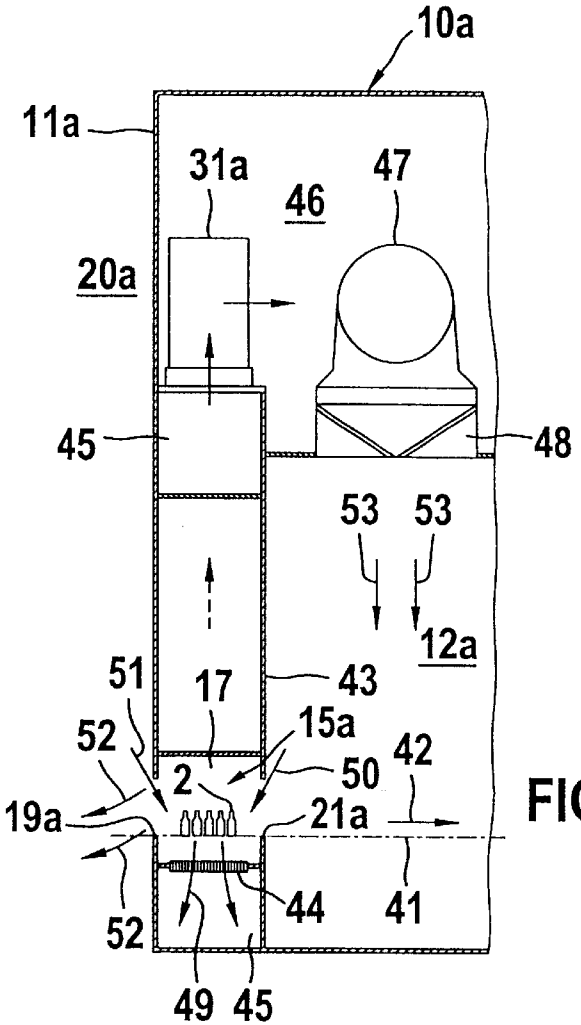
FIG. 3 is a fragmentary section taken along the plane III—III of FIG. 2 in the inflow region of the bottling systems.
Figure 2:
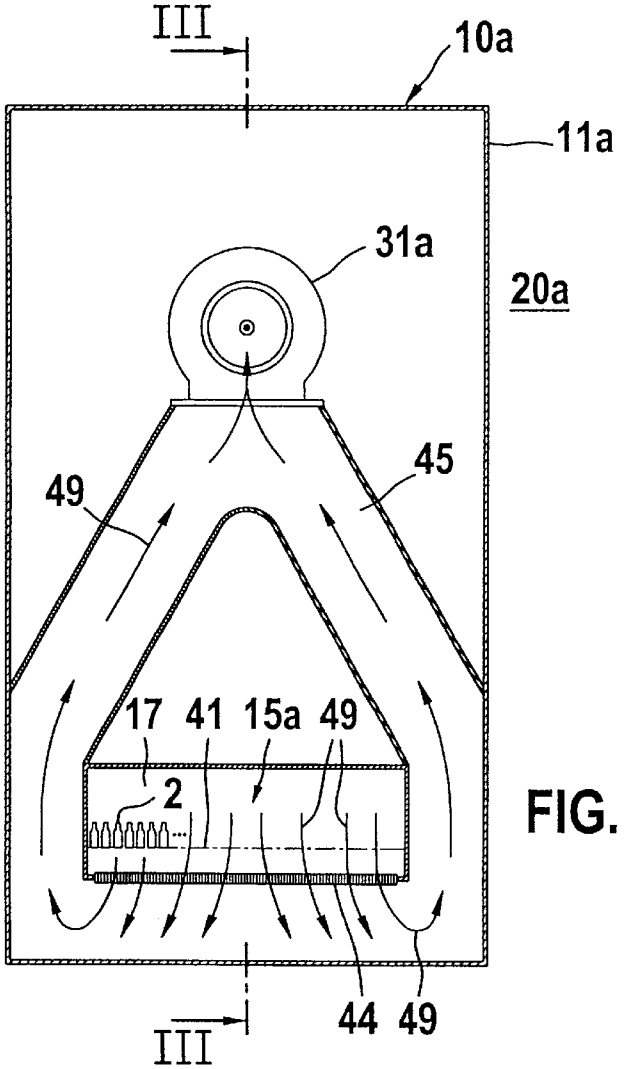
FIG. 2 is a simplified front sectional view of a bottling system of isolator construction.

In the second exemplary embodiment of the invention, shown in FIGS. 2 and 3, the apparatus 10*a* is embodied as a bottling system for liquid pharmaceuticals. The bottling is done into ampules 2, but vials or the like can also be filled. The boxlike housing 11*a* can be seen, through which the ampules 2 are shunted at the level of the transport plane 41 in the transport direction 42 (which in FIG. 2 is perpendicular to the plane of the drawing). The entrance gate 15*a* is integrated with the housing 11*a* and has a partition 43 dividing it from the production chamber or insulator interior 12*a*. Below the transport plane 41, a suction grid 44 is provided, which defines a suction conduit 45. Via the suction grid 44 and the suction conduit 45, air is aspirated out of the region of the entrance gate 15*a* by means of the blower 31*a*; this air then reaches a partitioned-off interstice 46 above the isolator interior 12*a*. A recirculating blower 47 is disposed in the interstice 46 and causes air to circulate in the isolator interior 12*a* via a clean-air filter 48.

As can be seen from the flow arrows 49 in FIG. 2, the air from the entrance gate 15*a* is aspirated away essentially downward into the suction conduit 45, and in the suction conduit 45, in the peripheral region near the bottom of the housing 11*a*, this air is deflected upward in the direction of the blower 31*a*.

It can also be seen from FIG. 3 that air from the isolator interior 12*a* flows into the entrance gate 15*a* (flow arrow 50). This is because, analogously to the first exemplary embodiment of FIG. 1, a higher pressure prevails in the isolator interior 12*a* than in the entrance gate 15*a*. The entry of contaminated air into the isolator interior 12*a* is prevented by this purposeful aspiration of the air out of the isolator interior 12*a*, as in the first exemplary embodiment.

From the flow arrows 51 and 52, it can also be seen that air either enters the entrance gate 15*a* from the outside region 20*a* or that air flows out of the entrance gate 15*a* into the outside region 20*a*, depending on whether a higher air pressure prevails in the outside region 20*a* than in the entrance gate 15*a*, or vice versa.

The entry of air from the outside region 20*a* into the entrance gate 15*a* prevents contaminated process air from escaping into the outside region 20*a*, which is especially desirable in the case of toxic products. Conversely, if there is a purposeful outflow of air from the entrance gate 15*a* into the outside region 20*a*, a purposeful pressure reduction in the isolator interior 12*a* compared to the outside region 20*a* can take place, so that less waste air, which would have to be replenished by compensatory fresh air, is generated by the apparatus 10*a*. As a result, the energy demand of the apparatus 10*a* is reduced.

It will also be noted that the apparatus 10*a*, as in the first exemplary embodiment, has an air flow corresponding to the entrance gate 15*a* or a corresponding construction on the outlet side of the apparatus 10*a* as well. In addition, the air flow in the isolator interior 12*a* is again embodied as a laminar air flow, but it flows around the ampules 2 essentially vertically from top to bottom. This kind of air guidance is already widely known in isolator technology, however.

The foregoing relates to preferred exemplary embodiments of the invention, it being understood that other variants and embodiments thereof are possible within the spirit and scope of the invention, the latter being defined by the appended claims.

What is claimed is:

1. In a method for air guidance in a processing chamber (12; 12*a*), in which an air flow is generated in a housing (11; 11*a*) that is closed off from an outside region (20; 20*a*) with the exception of essentially gate regions (17, 18), the air flow carrying air cleaned by means of a filter (32; 48) into the processing chamber (12; 12*a*) inside the housing (11; 11*a*), in particular via the filling and sealing region of packaging containers(1; 2), in order to avoid contamination of the product and of the packaging containers (1; 2), and having an intermediate region (25), through which manipulations in the processing chamber (12; 12*a*) are possible, and a first air flow (flow arrow 40) is embodied between the processing chamber (12; 12*a*) and the intermediate region (25), and a second air flow (flow arrow 36) is embodied between the intermediate region (25) and the filter (32; 48), and a higher air pressure prevails in the processing chamber (12; 12*a*) than in the intermediate region (25), the improvement wherein gaps (27) are formed between the intermediate region (25) and the outside region (20; 20*a*), and that a higher pressure prevails in the outside region (20; 20*a*) than in the intermediate region (25), so that air flowing into the interstice (25) through the gaps (27) is aspirated away and delivered to the filter (32; 48).

2. The method of claim 1, wherein the gate regions (17, 18) for the packaging containers (1; 2) have first openings (19; 19*a*) from the outside region (20; 20*a*) into the gate regions (17, 18) and second openings (21; 21*a*) from the processing chamber (12; 12*a*) into the gate regions (17, 18); that air from the gate regions (17, 18) is aspirated away (flow arrow 37; 49) to the filter (32; 48); and that air flows (flow arrows 39, 40; 50, 51) out of the processing chamber (12; 12*a*) and the outside region (20; 20*a*) into the gate regions (17, 18).

3. The method of claim 1, wherein the gate regions (17, 18) for the packaging containers (2) have first openings (19*a*) from the outside region (20*a*) into the gate regions (17, 18) and second openings (21*a*) from the processing chamber (12*a*) into the gate regions (17, 18); that air from the gate regions (17, 18) is aspirated (flow arrows 49) away to the filter (48); that air from the processing chamber (12*a*) flows into (flow arrow 50) the gate regions (17, 18); and that air from the outside region (20*a*) flows (flow arrow 51) into the gate regions (17, 18).

4. An apparatus (10; 10*a*) for air guidance in a processing chamber (12; 12*a*), comprising a housing (11; 11*a*) through which packaging containers (1; 2) can be shunted along a feed path (13) in order to be filled and sealed, a device (28) for keeping the processing chamber (12; 12*a*) inside the housing (11; 11*a*) clean, which device includes at least one blower (31; 31*a*, 47) and one filter (32; 48), a movable separator to enable interventions from an outside region (20; 20*a*) into the processing chamber (12; 12*a*), the separator (22) forming an intermediate region (25), which communicates via gaps (26, 27) with the processing chamber (12; 12*a*) and the outside region (20, 20*a*), and the intermediate region (25) having means for aspirating the air, flowing into the intermediate region (25), away to the blower (31; 31*a*, 47) and to the filter (32; 48).

5. The apparatus of claim 4, wherein the housing (11; 11*a*) has an entrance gate (15; 15*a*) and an exit gate (16) for the packaging containers (1; 2), which has first openings (19; 19*a*) to the outside region (20; 20*a*) and second openings (21; 21*a*) to the processing chamber (12; 12*a*), and that means for delivering air from the entrance gate (15; 15*a*) and the exit gate (16) to the blower (31; 31*a*, 47) are provided, to that in the entrance gate (15; 15*a*) and the exit gate (16) a pressure prevails that is lower than the pressure in the processing chamber (12; 12*a*) and in the outside region (20; 20*a*).

6. The apparatus of claim 4, wherein by means of the blower (31), an air flow (flow arrows 38) in the processing chamber (12) can be generated that is oriented essentially horizontally and transversely to the feeding direction of the packaging containers (1).

7. The apparatus of claim 6, wherein the blower (31) is disposed on the opposite side of the intermediate region (25), and the feed path (13) of the packaging containers (1) is located between the blower (31) and the intermediate region (25).

8. The apparatus of claim 4, wherein by means of the blower (47), an air flow (flow arrows 38) in the processing chamber (12*a*) can be generated that is oriented essentially vertically to the feeding direction of the packaging containers (2).

9. The apparatus of claim 4, wherein in the gate regions (17, 18), an air flow that flows vertically around the packaging containers (2) can be generated by means of the blower (31*a*).

10. The apparatus of claim 6, wherein at least the air flow in the processing chamber (12; 12*a*) (flow arrows 38; 53) is embodied as a laminar air flow.

11. The apparatus of claim 5, wherein by means of the blower (31), an air flow (flow arrows 38) in the processing chamber (12) can be generated that is oriented essentially horizontally and transversely to the feeding direction of the packaging containers (1).

12. The apparatus of claim 11, wherein the blower (31) is disposed on the opposite side of the intermediate region (25), and the feed path (13) of the packaging containers (1) is located between the blower (31) and the intermediate region (25).

13. The apparatus of claim 5, wherein by means of the blower (47), an air flow (flow arrows 38) in the processing chamber (12*a*) can be generated that is oriented essentially vertically to the feeding direction of the packaging containers (2).

14. The apparatus of claim 5, wherein in the gate regions (17, 18), an air flow that flows vertically around the packaging containers (2) can be generated by means of the blower (31*a*).

15. The apparatus of claim 5, wherein in the gate regions (17, 18), an air flow that flows vertically around the packaging containers (2) can be generated by means of the blower (31*a*).

16. The apparatus of claim 8, wherein in the gate regions (17, 18), an air flow that flows vertically around the packaging containers (2) can be generated by means of the blower (31*a*).

17. The apparatus of claim 13, wherein in the gate regions (17, 18), an air flow that flows vertically around the packaging containers (2) can be generated by means of the blower (31*a*).

18. The apparatus of claim 7, wherein at least the air flow in the processing chamber (12; 12*a*) (flow arrows 38; 53) is embodied as a laminar air flow.

19. The apparatus of claim 8, wherein at least the air flow in the processing chamber (12; 12*a*) (flow arrows 38; 53) is embodied as a laminar air flow.

20. The apparatus of claim 9, wherein at least the air flow in the processing chamber (12; 12*a*) (flow arrows 38; 53) is embodied as a laminar air flow.

* * * * *